US005154168A

United States Patent [19]

Schlobohm

[11] Patent Number: 5,154,168

[45] Date of Patent: Oct. 13, 1992

[54] RESPIRATOR MASK

[75] Inventor: Joachim Schlobohm, Salinenstrasse, Fed. Rep. of Germany

[73] Assignee: Dragerwerk Aktiengesellschaft, Lubeck, Fed. Rep. of Germany

[21] Appl. No.: 685,443

[22] Filed: Apr. 15, 1991

[30] Foreign Application Priority Data

May 30, 1990 [DE] Fed. Rep. of Germany ..... 4017336

[51] Int. Cl.[5] ..... A62B 7/10

[52] U.S. Cl. ..... 128/205.27; 128/206.12; 128/206.16

[58] Field of Search ..... 128/205.27, 205.29, 128/206.12, 206.16, 206.17

[56] References Cited

U.S. PATENT DOCUMENTS 4,579,113 4/1986 McCreadie et al. ..... 128/206.17
4,630,604 12/1986 Montesi ..... 128/206.17

FOREIGN PATENT DOCUMENTS 1625097 6/1951 Fed. Rep. of Germany .
1708046 8/1975 Fed. Rep. of Germany .

*Primary Examiner*—Edgar S. Burr
*Assistant Examiner*—Aaron J. Lewis
*Attorney, Agent, or Firm*—McGlew & Tuttle

[57] ABSTRACT

A respirator mask with connection openings for filters and a mask body, which is designed as a full mask or as a half mask, is improved such that subsequent conversion into one respirator mask configuration or another will be simplified and possible without the use of separate closing parts. To achieve this, a connecting adapter (2) with connecting ports (4, 10) can be fastened in at least two preferred positions on the full mask or half mask (1). A predetermined number of connection openings 8, 9 and connecting ports (4, 10) overlap in each preferred position. Various numbers of filters 3 can be connected to the overlapping areas, and the non-overlapping connection openings 8 are closed with sealing means 7 provided on the connecting adapter 2.

11 Claims, 6 Drawing Sheets

RESPIRATOR MASK

FIELD OF THE INVENTION

The present invention pertains to a respirator mask with connection openings for filters and a mask body, which is designed as a full mask or a half mask.

BACKGROUND OF THE INVENTION

A respirator mask with a mask body designed as a full mask has become known from West German Patent Specification No. DE-PS 17,08,046. This prior art respirator mask comprises a mask body with connection openings for filters and flutter valves and an internal half mask. The mask body is designed such that its shape, or the form in which it is manufactured, does not have to be changed when the connection ports for the filters or the flutter valves are to be installed. To achieve this, the mask body has desired points when needed and used to connect one or several filters or one or several flutter valves as desired. A defined respirator mask configuration is manufactured such that a single-piece mask body without openings is first prepared, recesses are subsequently punched through in the desired positions, and filters and/or flutter valves are fastened at the connections thus formed.

One drawback of the prior-art respirator mask is that the field of application of the respirator mask, e.g., as a single-filter respirator mask or as a two-filter respirator mask, is defined by the openings, once punched. Conversion to another respirator mask configuration is possible only if connecting ports that are no longer needed are closed by auxiliary parts. If, for example, a two-filter respirator mask with one flutter valve is converted into a single-filter respirator mask, an additional flutter valve must be inserted in place of the second filter, or a separate closing plug must be placed into the connection opening in the mask body. In addition, the prior art respirator mask involves the risk that recesses will be inadvertently punched through during the use of the respirator, and the respirator mask will therefore no longer be suitable for use because of the leak developed.

A half mask with connection openings for fastening filters and flutter valves has become known from West German Utility Patent No. DE-GM 16,25,097. According to a first embodiment of this prior art reference, two filters are arranged on the side of the half mask, and the flutter valve is located on the front side of the half mask in front of the mouth. In a second embodiment, only one filter is to be inserted into the connection opening of the flutter valve, and the breathing air is allowed to flow off via a rubber lip valve on the underside of the half mask. The lateral connection openings are closed in this state.

It is disadvantageous in the prior-art half mask that conversion from the configuration with two filters to that with a single filter is possible only if the connection openings that are no longer needed on the side are sealed by means of auxiliary parts. In the opposite case, i.e., in the case of conversion from one filter to two filters, a loose flutter valve must be installed in the half mask in place of the single filter, and the rubber lip valve on the underside must be closed. Consequently, the possibility of conversion is limited by the availability of certain auxiliary components. This method of conversion has not proved to be usable in practical application.

SUMMARY AND OBJECTS OF THE INVENTION

It is a primary object of the present invention to improve a respirator mask such that subsequent conversion to one respirator mask configuration or another will be simplified and possible without the use of separate closing parts.

According to the invention, a connecting adapter with connecting ports can be fastened on the full mask or half mask in at least two preferred positions. A predetermined number of connection openings and connecting ports overlap each other in each preferred position. Various numbers of filters can be connected in the overlapping areas, and the non-overlapping connection openings are closed with sealing means provided on the connecting adapter.

The essential advantage of the present invention relates to the fact that different respirator mask configurations can be realized with the connecting adaptor. This connecting adaptor is fastened in different preferred positions on the respirator mask, and defines connecting ports, into which connection openings filters can be inserted. At least one of the connecting ports are overlapped or aligned with connection openings on the respirator mask in each preferred position of the connecting adapter. Auxiliary parts for closing unused connection openings are not necessary, because these are closed with sealing means provided on the connecting adapter. The connecting ports in the connecting adapter are provided either as circular openings in the wall of the connecting adapter or as threaded bushings or plug-in type sockets.

Such a connecting adapter can be fastened either in a respirator mask with a full mask and internal mask or directly on a half mask.

In the case of the full mask, the connecting adapter is placed over the connection openings in the area of the mouth, and a predetermined number of connection openings and connecting ports will overlap in each preferred position. The connection openings are circular openings in the full mask. In the case of a rigid full mask, it is advantageous to make the connecting adapter from a flexible material in order for it to cling to the contours of the full mask. To seal off the overlapping areas of the connection openings and the connecting ports between the connecting adapter and the full mask against the atmosphere, annular sealing beads may be provided on the inside of the connecting adapter. The sealing beads prevent respiration gas from escaping from the overlapping areas into the atmosphere. The connecting adapter may also be designed as a change-over switch which is fastened on the full mask or is even part of the full mask and can be brought into the corresponding preferred position by rotating.

In the case of the half mask, the connecting adapter is directly attached to the half mask, and the filters are buttoned into the half mask. Since the half mask usually consists of a rubber-elastic material, the sealing function is assumed at the same time by the buttoning.

The respirators are usually used as single-filter and two-filter respirator masks. With the respirator mask according to the present invention, a single-filter respirator mask can be realized in a first preferred position, and a two-filter respirator mask can be realized in a second preferred position. In the single-filter respirator mask, the filter is fastened on the front side of the connecting adapter at the level of the mouth, whereas in the case of the two-filter respirator mask, the filters are arranged on the side flanks of the connecting adapter. Filters of identical design can be used for both configurations of the respirator mask, i.e., the single-filter respirator mask and the two-filter respirator mask.

The connecting adapter is designed such that it surrounds the side flanks of the half mask or of the full mask and is designed to hold the filters. In the case of a half mask, the connecting adapter is preferably made from a solid material and serves as a support for the half mask, because it is in contact with the elastic side flanks in a U-shaped pattern. Since the intrinsic weight of the filters is taken up completely by the connecting adapter, the half mask can be designed for exclusive sealing function and be manufactured from a soft, pliant material, e.g., silicone.

To improve the wearing comfort, the connecting adapter for a half mask is provided with bands to fasten the respirator mask on the respirator user's head. Due to the uniform introduction of the holding force over the front side and the side flanks of the half mask, uniform pressing against the face is achieved.

On the side facing the respirator mask, the connecting adapter is provided with closing plugs serving as sealing means, which can be buttoned into the non-overlapping connection openings and seal same. Buttoning in brings about reliable closure of the connection openings and does not lead to leakage even in the case of extreme deformation of the respirator mask.

In a preferred embodiment of the present invention, pit-like, rectangular recesses, which serve to center the filters and to secure them against rotation, are provided in the area of the connecting ports. The filters have a matching counterpart, which extends into the recess and is designed such that the filter can be fastened on the connecting adapter only in a defined position. Subsequent adjustment of the filter on the connecting adapter to achieve favorable wearing position for the respirator's user is no longer necessary.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
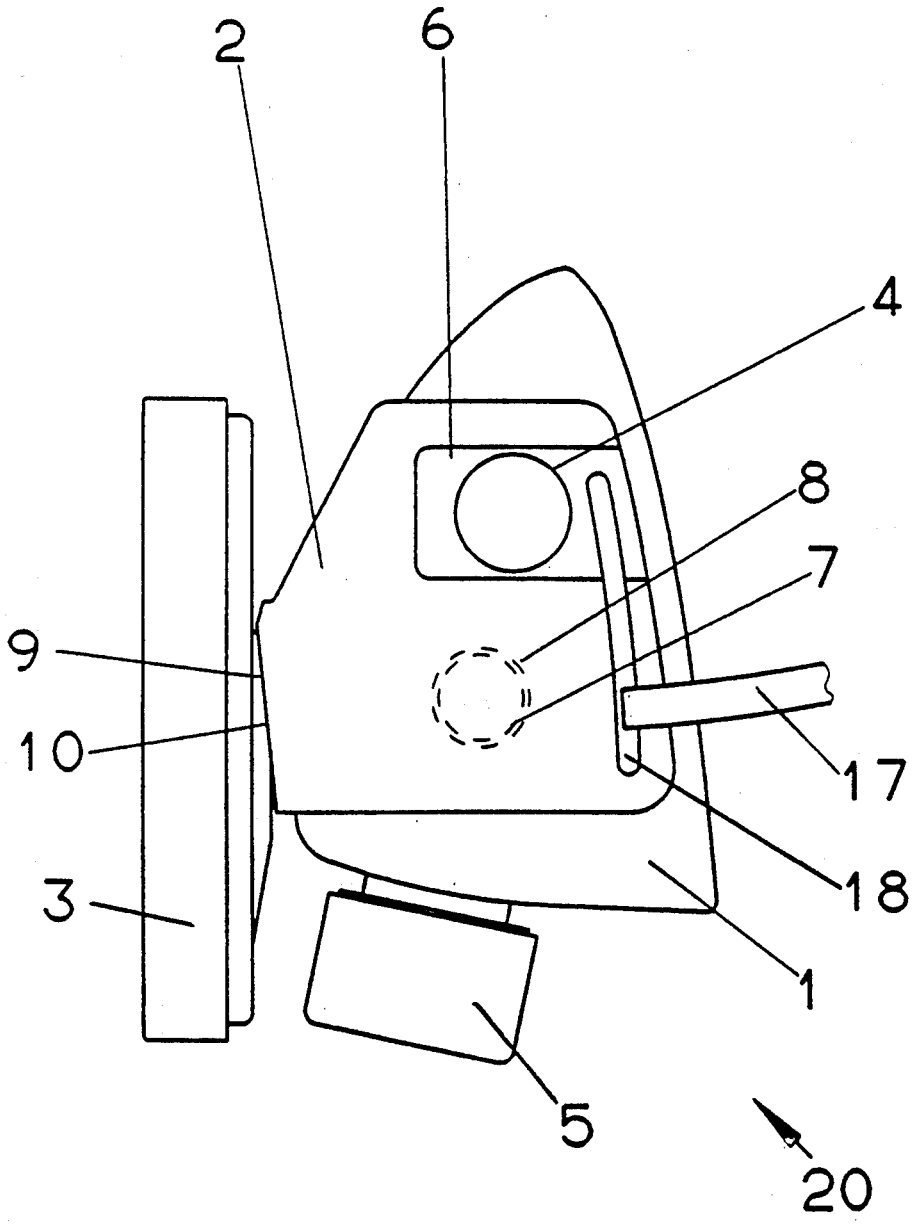
FIG. 1 is a side view of a respirator mask with one filter according to the invention.
Figure 2:
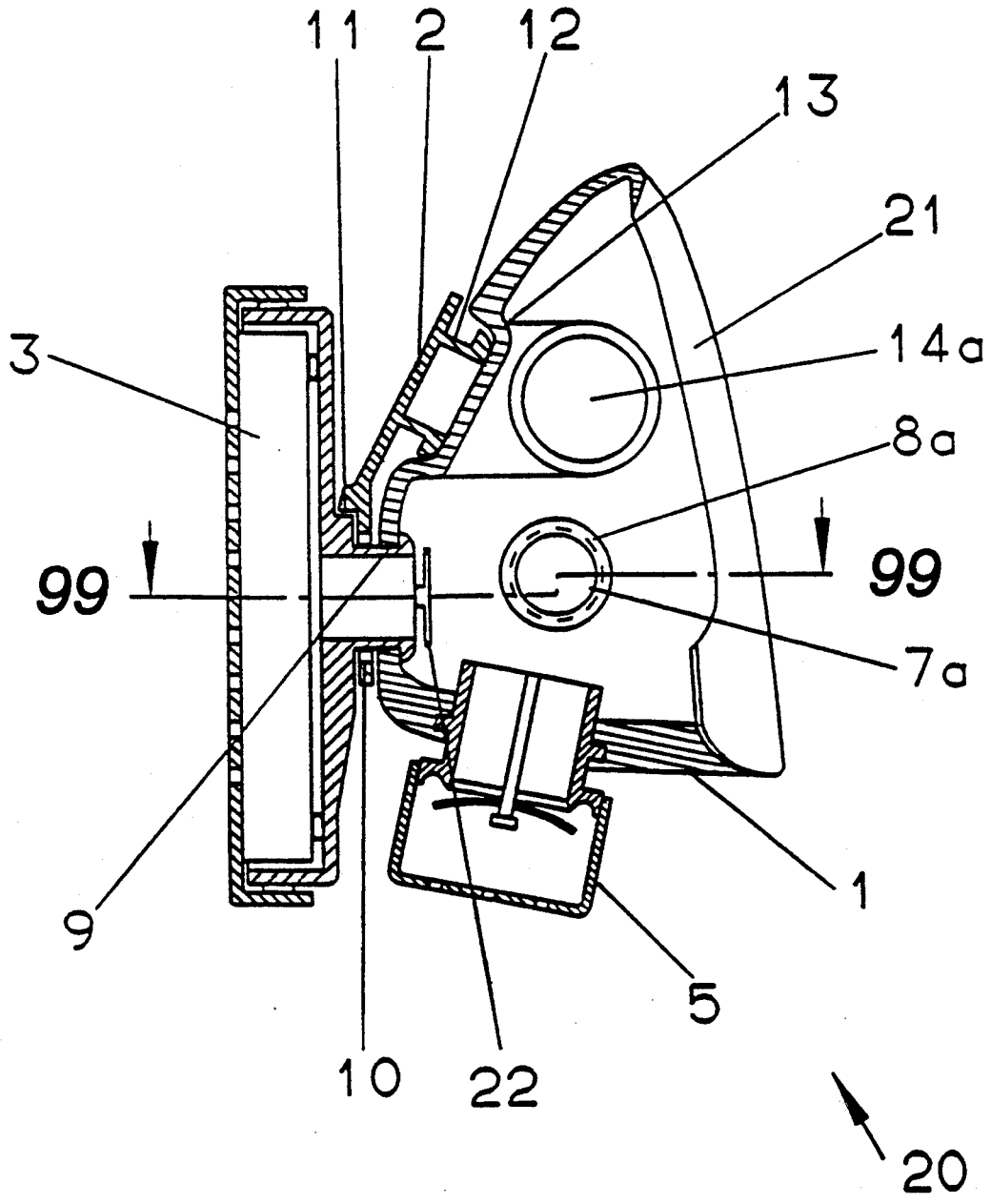
FIG. 2 is a longitudinal view of the respirator mask according to FIG. 1.
Figure 4:
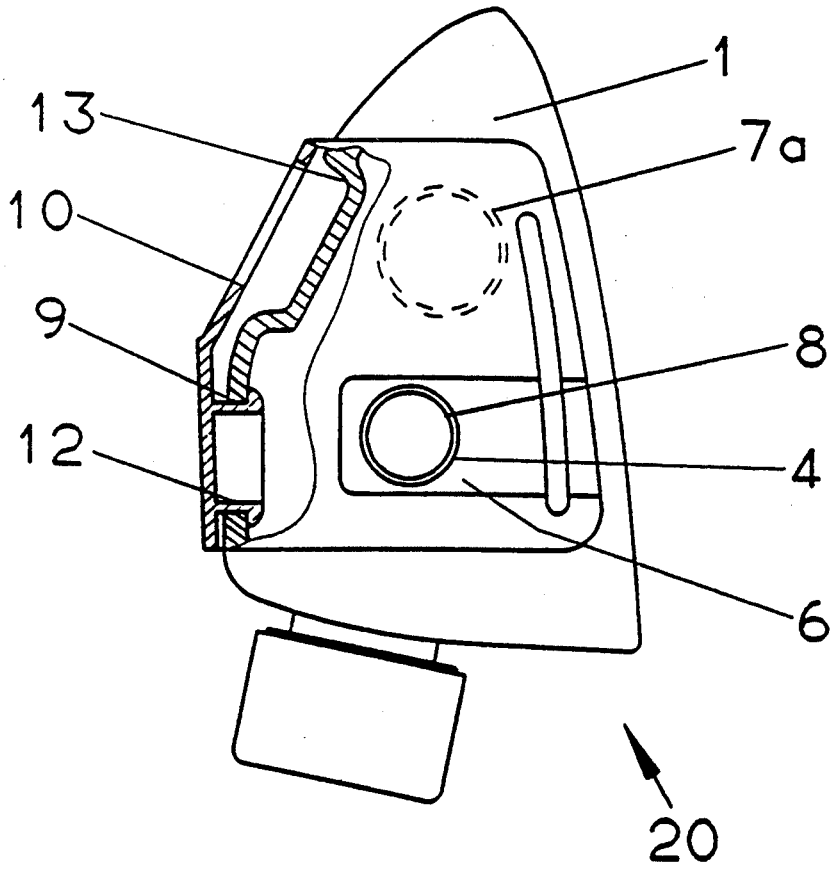
FIG. 4 is a respirator mask according to FIGS. 1 through 3 with the connecting adapter replugged to fasten two filters.

FIG. 1 shows the side view of a respirator mask 20 with a half mask 1 made from a rubber-elastic material, a connecting adapter 2 made from a solid material, one filter 3, a band 17, and a flutter valve 5. The respirator mask 20 is of symmetrical design; therefore, only one half is shown in FIGS. 1, 2, and 4. Symmetric components are designated by the same reference numerals with the suffix "a" added.

The connecting adapter 2 is placed onto the half mask 1 in a first preferred position, and in this position, it permits a single filter 3 to be fastened. The connecting adapter 2 surrounds, in the shape of a U, the elastic half mask 1, and the connecting adapter thus acts as a support for its side flanks. In the upper area of the connecting adapter 2, two connecting ports 4, 4*a* are provided as circular openings in the wall of the connecting adapter 2. The second connecting adapter 4*a* is located on the rear side and is not shown in FIG. 1. In the area of the connecting adapters 4, 4*a*, there is a rectangular, pit-like recess 6, 6*a*, which serves as a centering aid and as a rotation prevention means for the filters 3 to be mounted later. In the lower area of the connecting adapter 2, there are two closing plugs 7, 7*a*, which are provided on the inside of the connecting adapter 2 and point toward the half mask 1. The band 17 is guided in an oval eye 18, and can be adapted to the head of a respirator user (not shown) by displacement in the vertical direction.

FIG. 2 shows a vertical section through the respirator mask 20 according to FIG. 1. The half mask 1 of FIG. 2 has two closed connection openings 8, 8*a* and one filter connection opening 9. The connection openings 8, 8*a*, 9 are openings provided in the rubber-elastic wall of the half mask 1. In the position of the connecting adapter 2 shown, the connection openings 8, 8*a* are sealed with the closing plugs 7, 7*a*, which are part of the connecting adapter 2. The filter 3 is buttoned into the filter connection opening 9 of the half mask 1. The filter 3 is held in the filter connecting port 10 and is centered by a filter recess 11 of the connecting adapter 2. The filter connecting port 10 is designed as a circular opening in the wall of the connecting adapter 2. A matching counterpart of the filter 3 engages in the rectangular, pit-like filter recess 11, thus holding the filter 3 in the predetermined position. In the upper area of the connecting adapter 2, a filter closing plug 12, which extends into a filter recess 13 of the half mask 1, is provided on the inside. Corresponding recesses 14, 14*a* are provided on the side flanks of the half mask 1. The half mask 1 also has a circumferential sealing bead 21, which is in contact with the face of the respirator user (not shown). A directional valve 22 is provided to interrupt the flow of gas through the filter 3 during breathing out. The expired gas thus can escape only through the flutter valve 5.

Figure 3:
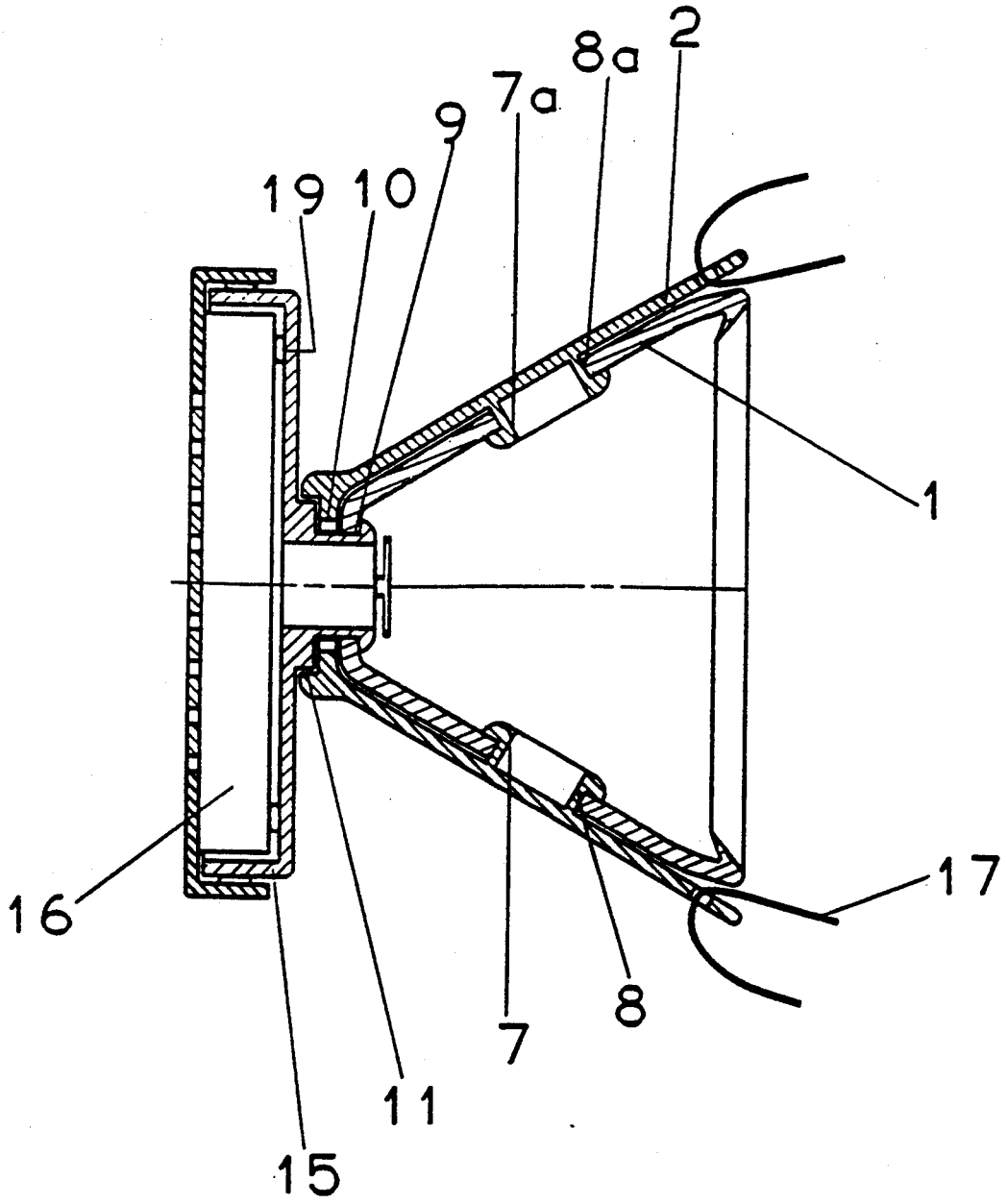
FIG. 3 shows a sectional view of a detail from FIG. 2 taken along line A—A.

FIG. 3 shows a sectional view of a detail from FIG. 2 along line A—A, in which the symmetrically arranged connection openings 8, 8*a* and closing plugs 7, 7*a* are recognizable. The filter 3 consists of a screw type housing 15, into which a filter cartridge 16 with a gasket 19 is inserted. To change the filter, the housing 15 is screwed on, and the filter cartridge is replaced. It is not necessary to button the filter 3 out of the filter connection opening 9.

FIG. 4 shows a respirator mask 20 with a connecting adapter 2, which is placed onto the half mask 1 in a second preferred position, and permits the connection of two filters 3 in this position. The conversion from the single-filter respirator mask according to FIGS. 1 through 3 to a two-filter respirator mask according to FIG. 4 is carried out by first buttoning the filter 3 and the closing plugs 7, 7a out of the connection openings 8, 8a, 9 (FIG. 3). The connecting adapter 2 is subsequently pulled off of the half mask 1, turned through 180° around a horizontal axis, and put back in place. In the new position (FIG. 4), the filter connecting port 10 is opposite the filter recess 13, and the closing plugs 7, 7a extend into the recesses 14, 14a (FIG. 2 and FIG. 4). Since the sides of the connecting adapter 2 are now inverted relative to the half mask 1, the closing plug 7a is now in the recess 14 and the closing plug 7 is in the recess 14a.

The filter connection opening 9 is sealed with the filter closing plug 12. The connecting ports 4, 4a overlap the connection openings 8, 8a of the half mask 1, and two filters 3 can be inserted here. These filters 3 are not shown in FIG. 4.

The filters 3 are centered on the connecting adapter 2 via the recesses 6, 6a. Filters 3 of identical design can be used for both configurations of the respirator mask, i.e., as a single-filter respirator mask or as a two-filter respirator mask.

Figure 5:
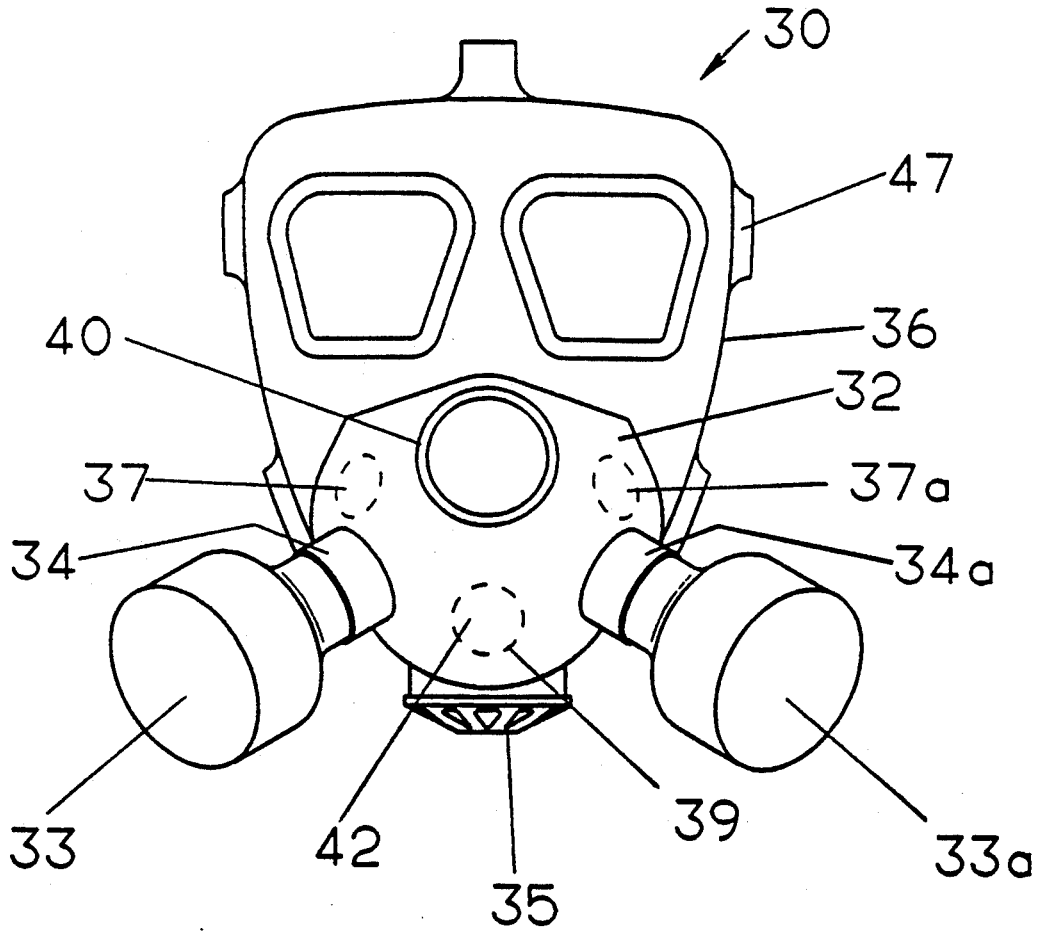
FIG. 5 is a front view of a respirator mask as a full mask with two filters.

FIG. 5 shows the front view of a respirator full mask 30 with a mask body designed as a full mask 36. A connecting adapter 32, two filters 33, 33a, a band 47, and a flutter valve 35 are connected to the full mask 36. The full mask 36 has connection openings 38, 38a (FIG. 6) and one filter connection opening 39, which are designed as circular openings in the wall of the full mask 36. The connecting adapter 32 is placed onto the full mask 36 in a second preferred position, and it permits two filters 33, 33a to be fastened in this position. In the lower area of the connecting adapter 32, two connecting ports 34, 34a are provided to accommodate the filters 33, 33a. A filter connecting port 40 is located in the upper area, and is used with one centrally arranged filter in the first preferred position. The connecting ports 34, 34a, 40 are designed as threaded bushes. Closing plugs 37, 37a and one filter closing plug 42, point toward the full mask 36, serve to close connection openings 38, 38a, 39, are provided on the inside of the connecting adapter 32. In the position shown, the filter connection opening 39 is sealed with the filter closing plug 42, and the connection openings 38, 38a (FIG. 6) overlap the connecting ports 34, 34a.

Figure 6:
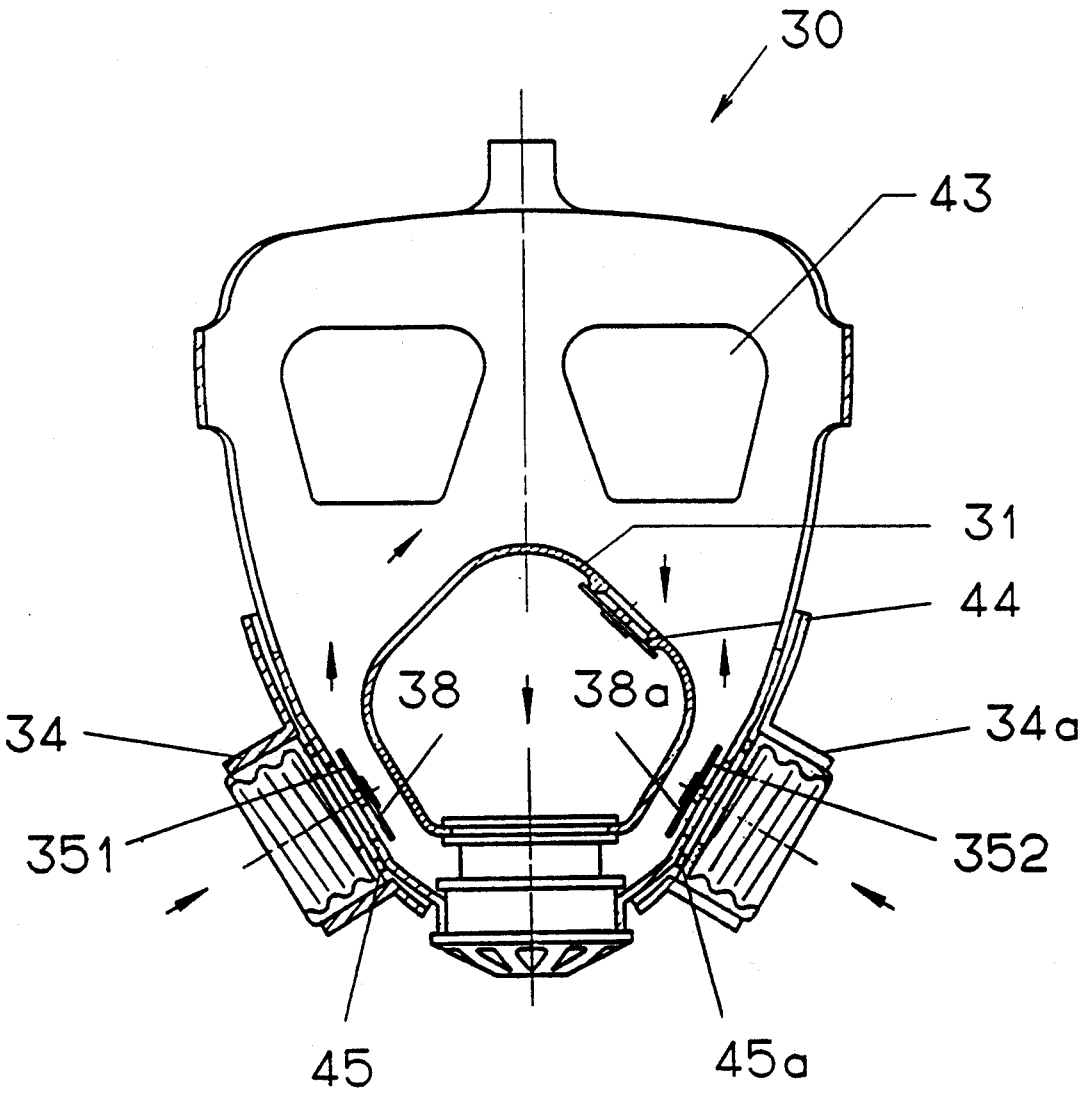
FIG. 6 is a sectional view of a respirator mask as a full mask with two filters.

FIG. 6 shows a sectional view of the respirator full mask 30 according to FIG. 5. The direction of gas flow is indicated by arrows. The gas enters via the connecting ports 34, 34a, the connection openings 38, 38a, and the directional valves 351, 352, sweeps over the lens 43, and enters the interior space of the inner mask 31 via a check valve 44. The exhaled air is discharged into the atmosphere via the flutter valve 35. In the second preferred position of the connecting adapter 32 with one filter, there is an equivalent gas pathway. Inside the connecting ports 34, 34a, 40, the connecting adapter 32 is provided with circumferential sealing beads 45, 45a, which seal the overlapping areas against the atmosphere.

The two-filter respirator full mask is converted into a single-filter respirator full mask by pulling off the connecting adapter 32 and putting it back in a position rotated through 180°. In the new position (not shown in the figures), the closing plugs 37, 37a are in the connection openings 38, 38a, and the filter connecting port 40 overlaps the filter connection opening 39. The connecting ports 34, 34a, 40 shown here are designed for screw type connection of the filters 33, 33a; however, it is also possible to use plug connection. Filters 33, 33a of identical design can be used for both configurations, i.e., as a single-filter respirator mask or as a two-filter respirator mask.

While specific embodiments of the invention have been shown and described in detail to illustrate the application of the principles of the invention, it will be understood that the invention may be embodied otherwise without departing from such principles.

What is claimed is:

1. A respirator mask arrangement, comprising:
a mask body including a plurality of openings; and,
a connecting adaptor including a predetermined number of connection openings and including sealing means for covering ones of said plurality of mask body openings, said connecting adaptor being connectable to said mask body in a first position in which at least a first connection opening of said connecting adaptor is positioned overlapping one of said mask body openings, and mask body openings not overlapped by said first connection opening being closed by said sealing means, said connecting adaptor being connectable to said mask body in a second position in which at least a second connection opening is positioned overlapping another of said mask body openings.

2. A respirator mask arrangement according to claim 1, wherein in said first preferred position a single filter can be connected to a mask body opening through an opening of said connecting adapter and in said second position two filters can be connected to first and second ones of said mask body openings through openings of said connecting adaptor.

3. A respirator mask according to claim 1, wherein said mask body includes side flanks, said connecting adaptor surrounding said side flanks, said connecting ports of said connecting adaptor providing holding support means for holding a filter.

4. A respirator mask according to claim 1, wherein said mask body includes a half mask, said connecting adaptor being connected to the half mask by means of a fastening band.

5. A respirator mask according to claim 1, wherein said sealing means of said connecting adaptor includes closing plugs for sealing said non-overlapping connection openings.

6. A respirator mask according to claim 1, wherein said mask body includes recesses for centering said filters and protecting the filters against rotation of said connecting adaptor.

7. A respirator mask in accordance with claim 1, wherein:
said sealing means forms an air-tight closure of said mask body openings not overlapping said connection openings.

8. A respirator mask in accordance with claim 1, wherein:
said sealing means is a plug which fits inside said mask body openings and said plug is attached to said connecting adaptor.

9. A respirator mask arrangement, comprising:
a mask body including a plurality of openings; and,
a connecting adaptor including a predetermined number of connection openings and including sealing means for covering ones of said plurality of mask body openings, said connecting adaptor being connected to provide a first assembly with said mask body where at least a first connection opening of said connecting adaptor is positioned overlapping one of said mask body openings, and makes body openings not overlapped by said first connection opening, being closed by said sealing means, said connecting adaptor being connected to provide a second assembly with said mask body with at least a second connection opening positioned overlapping another of said mask body openings.

10. A respirator mask arrangement, comprising:

a mask body including a plurality of openings; and, a connecting adaptor including a predetermined number of connection openings and including sealing means for covering ones of said plurality of mask body openings, said connecting adaptor having connection means for connecting said connecting adaptor to said mask body in a first position in which at least a first connection opening of said connecting adaptor is positioned overlapping one of said mask body openings, and mask body openings not overlapped by said first connection opening, being closed by said sealing means, said connection means also connecting said connecting adaptor to said mask body in a second position in which at least a second connection opening is positioned overlapping another of said mask body openings.

11. A respirator mask in accordance with claim 10, wherein:

said connection means is incorporated with said sealing means to both connect said connecting adapter to said mask body and to seal said not overlapped mask body openings.

* * * * *